US008961742B2

(12) United States Patent
Hédou et al.

(10) Patent No.: US 8,961,742 B2
(45) Date of Patent: Feb. 24, 2015

(54) MULTIAXIAL PRESS FELT BASE FABRIC INCLUDING CABLED MONOFILAMENTS

(75) Inventors: Daniel N. Hédou, Clinton, SC (US); Robert W. Huck, Fountain Inn, SC (US); Mario Lepage, Simpsonville, SC (US); Hanjiang Xu, Kanata (CA)

(73) Assignee: AstenJohnson, Inc., Charleston, SC (US)

( * ) Notice: Subject to any disclaimer, the term of this patent is extended or adjusted under 35 U.S.C. 154(b) by 175 days.

(21) Appl. No.: 13/555,511

(22) Filed: Jul. 23, 2012

(65) Prior Publication Data

US 2013/0020043 A1 Jan. 24, 2013

Related U.S. Application Data

(60) Provisional application No. 61/510,707, filed on Jul. 22, 2011.

(51) Int. Cl.
*D21F 7/08* (2006.01)

(52) U.S. Cl.
CPC *D21F 7/08* (2013.01); *D21F 7/083* (2013.01); *Y10S 162/90* (2013.01)
USPC ..... 162/358.2; 162/900

(58) Field of Classification Search
CPC ..... D21F 7/08; D21F 7/10; D21F 7/12; D21F 7/083; D21F 1/0027; D21F 1/10; D21F 1/0036; D21F 1/0045; D21F 1/0054; B32B 5/024; B32B 5/08; B32B 5/12; B32B 5/22; B32B 5/24; B32B 5/26; B32B 7/005; B32B 2250/20; D03D 15/0027; D03D 15/0083; D03D 15/0094; D03D 25/005; D03D 11/00; D03D 3/02; D03D 3/04
USPC ..... 162/348, 358.1, 358.2, 900–904; 139/383 A, 425 A, 383 AA; 428/193, 58, 428/397; 442/270; 28/110, 142
See application file for complete search history.

(56) References Cited

U.S. PATENT DOCUMENTS

| | | | | | |
|---|---|---|---|---|---|
| 4,414,263 | A | * | 11/1983 | Miller et al. | 442/270 |
| 4,632,716 | A | * | 12/1986 | Smith | 156/148 |
| 5,268,076 | A | | 12/1993 | Best et al. | |
| 5,360,656 | A | * | 11/1994 | Rexfelt et al. | 428/193 |
| 5,368,696 | A | * | 11/1994 | Cunnane et al. | 162/358.2 |
| 5,508,094 | A | | 4/1996 | McCarthy et al. | |
| 5,525,410 | A | | 6/1996 | Hansen | |
| 5,618,612 | A | | 4/1997 | Gstrein | |
| 5,651,394 | A | * | 7/1997 | Marchand | 139/383 A |

(Continued)

FOREIGN PATENT DOCUMENTS

EP 2042653 4/2009

*Primary Examiner* — Eric Hug
(74) *Attorney, Agent, or Firm* — Volpe and Koenig, P.C.

(57) ABSTRACT

A multiaxial press felt base fabric construction is provided in which the base fabric is formed from a spirally wound precursor textile strip having a width that is less than an overall width of the assembled papermaking fabric and which is joined together along neighboring adjacent edges to form a fabric tube. At least one of: 100% of the MD yarns located on one surface of the precursor textile strip are comprised of cabled yarns or from 50% to 100% of the CD yarns are a cabled yarn. The MD yarns are arranged as vertically stacked pairs for compression resistance to provide void volume, and the vertically stacked arrangement is maintained by interweaving with one system of CD weft yarns.

19 Claims, 9 Drawing Sheets

(56) References Cited

U.S. PATENT DOCUMENTS

| | | | | |
|---|---|---|---|---|
| 5,887,630 | A * | 3/1999 | Shipley | 139/383 A |
| 6,077,397 | A * | 6/2000 | Shipley | 162/358.1 |
| 6,699,367 | B2 | 3/2004 | Gstrein et al. | |
| 7,207,355 | B2 * | 4/2007 | Lee | 139/383 A |
| 7,384,515 | B2 | 6/2008 | Byfeldt et al. | |
| 7,473,336 | B2 | 1/2009 | Hawes et al. | |
| 7,478,655 | B2 | 1/2009 | Nakajima | |
| 7,722,743 | B2 | 5/2010 | Best et al. | |
| 2003/0085011 | A1 * | 5/2003 | Burazin et al. | 162/109 |
| 2005/0167069 | A1 | 8/2005 | Kobayashi et al. | |
| 2010/0200188 | A1 | 8/2010 | Ogiwara | |
| 2012/0145349 | A1 | 6/2012 | Ogiwara | |

* cited by examiner

MULTIAXIAL PRESS FELT BASE FABRIC INCLUDING CABLED MONOFILAMENTS

CROSS-REFERENCE TO RELATED APPLICATIONS

This application claims the benefit of U.S. Provisional Application No. 61/510,707, filed Jul. 22, 20111, which is incorporated herein by reference as if fully set forth.

FIELD OF THE INVENTION

The present invention concerns woven, multi-axial press felt base fabric constructions and, in particular, those which further include cabled monofilaments as a portion of either, or both, the MD or CD yarns.

BACKGROUND OF THE INVENTION

In the papermaking process, a dilute slurry consisting of about 0.3 to 1% papermaking fibers together with a mixture of about 99% water and other papermaking components is ejected at high speed and precision from the slice opening of a headbox onto a moving forming fabric. The fabric is guided and driven by a number of rolls over various drainage boxes and foils which assist in the removal of water so as to leave behind a randomly dispersed, loosely cohesive network or web of papermaking fibers. At the end of the forming section, this web is transferred to the press section, where further water removal occurs by mechanical pressures as the web is conveyed on or between a series of press fabrics through one or more nips. The now self-supporting but still very wet web is then transferred to the dryer section of the papermaking machine where the remaining water is removed by evaporation. The resulting paper product may then be exposed to various treatments before it is then finally wound onto a reel, cut to size and packaged for shipment.

The main functions of the press fabric are to transport water away from the sheet as it passes through the nip while providing uniform support and pressure distribution so that the fabric does not unduly mark the sheet. There are several press fabric constructions in common commercial use today including: seamed flat woven designs, endless woven or tubular type fabrics, and multiaxial fabrics; the latter two may or may not include a seam. Regardless of construction, the press fabric will ideally have adequate void volume and permeability, low compressibility and resist compaction under load. The present invention concerns a multiaxial press fabric which exhibits these properties.

Multiaxial press felts (or fabrics) are well known and have been described, for example, in U.S. Pat. No. 5,360,656 (Rexfelt et al.), U.S. Pat. No. 5,268,076 (Best et al.) and others. In these known multiaxial press felts, the base fabric is assembled from a continuous, flat woven precursor strip whose width is much less than the finished width of the press felt. This assembly is accomplished by spirally winding successive turns of the strip between two separated rolls, such that each turn is canted at a small angle to the intended machine direction (MD) of the completed felt. Each succeeding turn of the precursor strip is bonded along its longitudinal edges to the adjacent strip so that the base fabric possesses a degree of cohesion sufficient to allow it to be removed from the rolls. At this point in the manufacturing process, the base fabric is a continuous tubular loop which is subsequently collapsed and flattened to provide a two-layer structure at whose opposing ends seaming areas are formed. The collapsed double layer structure has an interior, and exterior paper side (PS) and machine side (MS) surfaces (see FIG. 2). One or more layers of a nonwoven fibrous batt are needled onto one or both of the PS and MS surfaces during subsequent process steps.

It is known from U.S. Pat. No. 7,207,355 to Lee ("the '355 patent") to employ, in a multiaxial press felt, a base fabric weave construction in which a single system of weft yarns is interlaced with two warp yarn systems so as to locate and maintain the individual warp yarns of the first system in a vertically stacked alignment with the yarns of the second system. This unique yarn configuration enables the fabrics to better provide and maintain their void volume in comparison to prior art fabrics lacking this construction because the stacked yarns resist nesting between each other and thus prevent fabric compression. The novel yarn arrangement also allows for the formation of MD oriented, vertically aligned seaming loops where the warp yarns pass from the PS to the MS surface of the fabric at the opposing folded ends where the seam is installed. Fabrics made in accordance with this patent have been found to perform well and are low marking. As disclosed in the '355 patent, the novel fabric construction is comprised solely of monofilament yarns.

Although multiaxial press felts such as those described by Best et al. and Rexfelt et al. have met with great success in the marketplace, a problem common to all such spirally wound fabrics concerns the appearance of interference patterns in their base fabrics. These patterns often occur when the two layers of precursor strips, both having the same weave pattern and yarns, are overlaid upon one another when the tubular loop is collapsed upon itself to form the base during assembly. The patterns produce what is sometimes referred to as the Moiré effect, and manufacturing complications associated with the effect in such fabrics are well known and have been described elsewhere (see, for example, U.S. Pat. No. 7,473,336 to Hawes et al.).

These interference patterns have created problems that adversely impact the mass uniformity of the staple fiber batt which is needled onto the base fabric. The interference patterns are produced because the MD and CD yarns in each layer of the precursor strips are of the same size and spacing, and are oriented at equal but opposite directions to the final intended MD and CD of the fabric. This creates regions of relatively higher and lower yarn densities in the base fabric. When batt is subsequently needled to the base fabric, its ability to adhere (due to fiber entanglement) in areas with lower yarn densities is less than in areas of higher yarn density. When used as a press fabric in the press section of a papermaking machine, felts with uneven base fabric yarn densities will tend to shed batt fibers comparatively more rapidly from areas of low yarn density because there are fewer yarns there to provide anchorage for them. Batt fiber shedding continues during fabric use, and the mass non-uniformity in the press felt becomes more pronounced, eventually causing uneven dewatering of the paper sheet because the press nip(s) are unable to apply constant pressure to the fabric and sheet. Uneven pressure application at the nip also reduces sheet smoothness, which is undesirable. In addition, the operational life for the press felt is shorter than could otherwise be obtained due to this loss of batt fiber (because the fabric may be removed prematurely).

DISCUSSION OF THE PRIOR ART

One known means of improving batt fiber retention is to use cabled, twisted or plied monofilament or multifilament yarns as a portion of the base fabric yarns. For example, U.S. Pat. No. 5,618,612 to Gstrein discloses a full width, flat woven press felt base fabric including fine plied monofilament twist yarns in the CD. U.S. Pat. No. 6,699,367 to Gstrein et al. proposes a seamed felt including twisted or braided CD or MD yarns to improve batt adhesion. The yarns are preferably comprised of three monofilaments twisted together.

U.S. Pat. No. 5,525,410 to Hansen discloses a press felt base fabric woven using cabled nylon, polyester or polyurethane monofilaments of a diameter ranging from 0.04-0.18 mm. The fabrics can be woven flat, endless, or made by the spiral winding process (i.e. multiaxial). There is no disclosure of stacked MD yarns in the base fabric.

U.S. Pat. No. 5,508,094 to McCarthy et al. describes a flat or endlessly woven multilayer press felt base fabric including at least one system of fine monofilament warp, and at least 2 layers of weft, one of which may include polyurethane coated load bearing multicomponent yarns. The term "multicomponent" is used to denote a multifilament, cabled yarn whose individual components are "fine" filaments, such as one comprised of 8 strands of 0.10 mm filaments twisted together; however, the filaments need not be twisted.

U.S. Pat. No. 5,651,394 to Marchand discloses a press felt base fabric woven using oval monofilaments or cabled oval monofilaments oriented in either the MD or CD.

U.S. Pat. No. 7,478,655 to Nakajima describes a multilayer pulp press fabric including as weft yarns chenille, spun, flocked or similar multifilaments that are arranged so as to provide long yarn floats on the MS with monofilaments in between each.

U.S. Pat. No. 7,473,336 to Hawes et al. discloses a multiaxial press felt having improved pressing uniformity and reduced sheet marking in which either: a) the spacing between the MD and/or CD yarns of the base fabric varies, b) a nonwoven layer is placed between upper and lower woven layers, or c) the mating surfaces of the upper and lower layers is calendared to reduce the height of yarn knuckles and minimize nesting of the yarns.

U.S. Pat. No. 7,384,515 to Byfeldt et al. discloses a method of forming a seam in a 4-layer multiaxial fabric similar to that disclosed in the '355 patent by cutting selected MD yarns and using the remainder to form seaming loops to render the fabric endless.

U.S. Pat. No. 7,722,743 to Best et al. discloses a method of making a nonwoven spirally wound press felt comprised of an MD module and a CD module which are overlaid one on the other. Each module is made of laser energy absorbing yarns attached to a nonwoven base. The yarns can be bi-component, multifilament or cabled monofilaments of which at least a portion contain the laser energy absorbing material; differing yarns types can be mingled together.

US patent publication number 2005/0167069 to Kobayashi et al. teaches a press felt base fabric in which one of either the CD or MD yarns is a "twine" made from filament having a fineness of 50 to 250 dtex, and the other thereof is a single yarn having a fineness of 50 to 600 dtex.

US patent publication number 2010/0200188 to Ogiwara discloses a press felt in which at least one of the MD or CD yarns in the PS of the base fabric is a multifilament yarn consisting of a bundle of fine diameter filaments with or without twist, the component yarns having a fineness of 100 dtex or less; use of this construction in a multiaxial type base fabric is disclosed for the purpose of increasing batt adhesion.

US patent publication number 2012/0145349 to Ogiwara discloses a woven press felt base fabric including additional warp yarns comprised of a material different from that of the remaining base fabric warp yarns; examples of the additional materials include twisted monofilaments, multifilaments, spun or staple yarns, or yarns of differing size or composition.

European patent publication EP 2,042,653 to Ito discloses a press felt base fabric in which flattened, soft twisted multifilaments (including core-in-sheath composite fibers) are used as either the warp or weft yarns to increase surface smoothness.

None of these prior art solutions provides a base fabric construction which enables the resulting felt to maintain batt fiber mass uniformity and void volume over an extended service life when cabled yarns replace a portion of the monofilament yarns in the woven fabric.

SUMMARY OF THE INVENTION

Thus, what is needed is a yarn arrangement for use in the precursor strip and base fabrics used in multiaxial press felts constructed in accordance with the '355 patent which will provide uniform and secure anchorage for the batt fibers needled into them. The improved yarn anchorage will help maintain batt fiber mass uniformity during use by decreasing fiber shedding over the felt surface, thus allowing for more even pressure application to the sheet, resulting in more uniform dewatering and increased operational life in comparison to similar fabrics of the prior art. In addition, the yarn arrangement should help maintain void volume in the resulting fabric over its service life, excellent water removal at the nip and low sheet marking. The present invention addresses these needs by providing a multiaxial press felt base fabric construction in which in which at least one of: 100% of the MD yarns located on one surface of the precursor textile strip are comprised of cabled yarns or from 50% to 100% of the CD yarns are a cabled yarn, in which fabrics the MD yarns are arranged as vertically stacked pairs for compression resistance to provide void volume, and in which the vertically stacked arrangement is maintained by interweaving one system of CD weft yarns.

In the present invention, the flat woven precursor textile strip from which the base fabric is formed is comprised of two systems or layers of linearly extending, vertically stacked MD oriented warp yarn arranged as pairs, interwoven with CD oriented weft yarns in the manner described in the '355 patent which maintains their stacked alignment so that one warp pair member is located on a first textile surface, while the other is vertically stacked and located immediately below the first on the second and opposing planar surface. In the strip, at least a portion of either, or both, the MD yarns, or the CD yarns, is comprised of cabled monofilaments, the remainder of the yarns in the strip being single monofilament yarns. In the fabrics of this invention, the cabled yarns comprise at least 50% of at least one of the CD or MD yarns and, in specific arrangements, comprise either from 50% to 100% of the CD yarns of the strip, or 100% of the MD yarns located on one of either the first or second surface of the fabric (i.e.: 50% of the MD warp yarns may be cabled), or 50% of the CD yarns and 100% of the MD yarns located on one of the fabric surfaces.

When used as 50% of the CD yarns, the cabled yarns are arranged so as to alternate with the single monofilament CD yarns in a regular interchanging manner, such as a repeating A,B,A,B,A,B pattern. The outside diameter of the cabled yarns is within about 150% or less of the outside diameter of the monofilament yarns which are oriented in the same direction in the woven base fabric (i.e.: the warp or weft yarns).

The novel yarn arrangements of the fabrics of the present invention address several deficiencies of prior art multiaxial press felts. First, by using cabled yarns in place of selected single monofilament yarns in the fabric, it is now possible to significantly reduce batt fiber shedding, particularly as it arises from interference effects caused by overlaying two identical fabric layers over one another because the cabled yarns provide more opportunity for batt fiber entanglement while disrupting the interference patterns. Second, because only a selected portion of the base fabric yarns are cabled yarns while the remainder are singleton monofilaments, the desired void volume and compression resistance properties of the base fabric are maintained over a greater proportion of the fabrics operational life in comparison to the prior art because the monofilaments are incompressible and the MD yarns are stacked over one another. Third, the stacked MD yarns allow for the formation of a low-marking seam in the manner described in the '355 patent, the content of which is expressly incorporated herein by reference as if fully set forth. Fourth, the useful life of the novel fabric is lengthened in comparison to other multiaxial press felt constructions because the cabled yarns are better able than single monofilaments to positively bind and anchor the batt fibers, and thus maintain the mass uniformity of the batt over a longer period of time. Fifth, the resulting precursor fabric is sufficiently stiff and stable to allow for subsequent assembly processes, including edge bonding, fringing and seam loop formation; fabrics in which 100% of the component yarns are either cabled or of similar complex constructions have been found to be too soft and "sleazy" to be easily manipulated in these processes.

Because cabled yarns replace only a portion of the single monofilament yarns in the known base fabric, important fabric properties including caliper, void volume and compressibility are maintained at levels similar to those found in fabrics comprised of 100% monofilament yarns, such as are disclosed in the '355 patent. The cabled yarns are also effective to minimize or completely eliminate the interference patterns found in similar, all-monofilament fabrics. Additionally, fabrics made according to the disclosed construction maintain their batt uniformity and smoothness over prolonged periods of time, thus increasing their useful service life in comparison to similar fabrics which are not so constructed.

Here, a multiaxial press felt is also provided for use in the press section of a papermaking machine, the felt having a paper side (PS) surface and a machine side (MS) surface and comprising:

a) a base fabric formed from a woven and spirally wound planar precursor textile strip whose width is less than an overall width of the assembled press felt, and which strip is joined together to an adjacent strip along its longitudinal edges to form a continuous tubular loop having an exterior and interior surface, which loop is collapsed to create the base fabric;

b) the planar precursor textile strip having first and second surfaces and comprising a system of generally linearly extending, vertically stacked pairs of machine direction (MD) yarns interwoven with a system of cross-machine direction (CD) yarns according to a pattern repeat which maintains a vertically stacked alignment of the paired MD yarns such that 50% of the paired MD yarns are located on a first surface of the strip, and a remaining 50% of the paired MD warp yarns are located on a second surface of the precursor textile strip;

c) the precursor textile strip further including both polymeric single monofilament and cabled yarns, wherein:

the cabled yarns comprise at least two monofilaments cabled together and the cabled yarns comprise at least 50% of at least one of the CD or MD yarn systems.

Preferably, 100% of the MD yarns on a first surface of the strip are cabled monofilaments while 100% of the CD yarns are single monofilaments.

Alternatively, 100% of the MD yarns on a second surface of the strip are cabled monofilaments and 100% of the CD yarns are single monofilaments.

As a further alternative, 100% of the MD yarns on either a first or a second surface of the strip are cabled monofilaments and 50% of the CD yarns are single monofilaments and the remaining 50% of the CD yarns are cabled monofilaments arranged so as to alternate in a chosen manner with the single monofilaments. Preferably, in these constructions, the cabled yarns are arranged such that they alternate with the single monofilament yarns that are oriented in the same direction in one of: an A,B,A,B,A,B repeating arrangement, or an AA,B-B,AA,BB or similar regular and alternating arrangement wherein A represents a cabled yarn, and B represents a single monofilament yarn.

Preferably, the cabled yarns comprise from 50% to 100% of the CD yarns of the precursor textile strip and 100% of the MD yarns are single monofilaments. More preferably, the cabled yarns comprise 50% of the CD yarns and 100% of the MD yarns are single monofilaments. Alternatively, the cabled yarns comprise 50% of the CD yarns and 100% of the MD yarns located on a first surface of the strip, while the remaining CD yarns and the MD yarns on the second surface are all single monofilaments.

In a construction which is presently preferred, 100% of the MD yarns in both the first and second surfaces are single monofilaments, and 50% of the CD yarns are cabled monofilaments arranged so as to alternate in a regular A,B,A,B,A,B manner with single monofilament CD yarns.

Preferably, the outside diameter of the cabled yarns is within 150% of the outside diameter of a single monofilament oriented in the same direction.

In another embodiment, a seamed multi-axial papermaking fabric is provided having a PS surface and an MS surface, which comprises:

a base fabric formed from a woven and spirally wound precursor textile strip whose width is less than an overall width of the final assembled papermaking fabric and which is joined together along neighboring adjacent edges to form a fabric tube, the precursor textile strip comprising a system of generally linearly extending vertically stacked pairs of MD warp yarns interwoven with a system of CD weft yarns according to a repeating pattern which maintains the vertically stacked alignment of the paired MD warp yarns such that 50% of the warp yarns are located on a first surface of the strip, and the remaining 50% of the warp yarns are located on the second surface of the precursor textile strip, the fabric tube comprises an upper layer and a lower layer formed by successive turns of the spirally wound precursor textile strip, the upper and lower layers being in vertical adjacency to one another in the base fabric, ends of the base fabric are formed by CD folds in the fabric tube to provide seaming areas, the warp yarns of each of the first and second surfaces of the strip being in a generally vertically stacked alignment within both of the layers adjacent to the folded ends of the base fabric to provide at least some continuously extending ones of the warp yarns from the first and second surface of the strip between the upper and lower layers at the seaming areas, seaming loops formed from at least some of the continuously extending ones of the warp yarns located at the CD folds in the fabric tube, the precursor textile strip further including both polymeric single monofilament and cabled yarns, wherein the cabled yarns comprises at least two monofilaments cabled together and the cabled yarns comprise at least 50% of at least one of the CD yarns or the MD yarns.

In one embodiment, 100% of the MD yarns located in the first surface of the strip comprise cabled yarns.

In another embodiment, 100% of the MD yarns located in the second surface of the strip comprise cabled yarns.

In another embodiment, from 50% to 100% of the CD yarns of the precursor textile strip comprise cabled yarns.

Preferably, the cable construction of the cabled yarns is selected from one of:

a. 1×3 (3 yarns plied together to form one cabled yarn),
b. 2×2 (two monofilaments plied together, and twisted with another pair of twisted monofilaments to form a single cabled yarn comprising 4 monofilaments), and
c. 2×3 (two monofilaments plied together, and twisted with two pairs of similarly plied monofilaments to form a single cabled yarn comprising 6 monofilaments).

A 2×2 cabling arrangement is presently preferred.

In a further alternative, the cabled yarns are plied with a multifilament such that the multifilament forms a sheath about the exterior of the cabled yarn. Preferably, the multifilament is comprised of a polyamide. Alternatively, at least one of the monofilaments comprising the cabled yarns is a bicomponent yarn including a low melt polymer adhesive as one of its components. As a further option, at least one of the monofilaments comprising the cabled yarns is a hollow monofilament.

In the multiaxial press felt base fabric constructions of the present invention, both the cabled yarns and the single monofilaments are preferably comprised of a polyamide (nylon). Preferably, the polyamide is one of polyamide-6 (PA-6), polyamide 6-10 (PA-610) or polyamide 6-12 (PA-612); others may be suitable. More preferably, the CD components of the base fabric are comprised of PA-610 and the MD components are comprised of PA-6. Alternatively, both the cabled yarns and the single monofilaments in each of the MD and CD are comprised of the same polymer.

Preferably, the outside diameter of a cabled yarn used in the fabrics of the invention is within about 150% of the outside diameter (or size, in the case of non-round cross-sections) of the monofilament yarns in the same yarn system. For example, where a cabled yarn and a single monofilament are used alternatingly in the same direction, if the diameter of the monofilament is 0.30 mm, the outside diameter of the cabled yarn can be no greater than 0.45 mm.

Preferably, the cross-sectional shape of the monofilament MD and CD yarns is one of: circular, ovate, elliptical, rectangular, square, flat or hollow. More preferably, the cross sectional shape of the MD and CD yarns is circular.

It has been found that beneficial results are obtained when cabled yarns are used in one of the following arrangements in the woven precursor fabrics:

a. the cabled yarns comprise 100% of one of the two vertically stacked pairs of yarns in the MD warp yarn system such that they comprise 50% of the total number of warp yarns in the fabric; or
b. the cabled yarns comprise 100% of the warp yarns located on the fabric surfaces of the precursor strip which are oriented towards one another at the interior of the collapsed fabric tube; or
c. the cabled yarns comprise from 50% to 100% of the CD weft yarns of the precursor textile strip, and all of the MD warp yarns are single monofilaments; preferably the cabled yarns comprise 50% of the CD yarns; alternatively they comprise 100% of the CD yarns; or
d. the cabled yarns comprise 50% of the CD yarns the remainder being single monofilaments, and 100% of one of the two vertically stacked pairs of yarns in the MD warp yarn system; and
e. the outside diameter of the cabled yarns is within about 150% of the outside diameter of the monofilament yarns used in the same yarn system.

A construction of the woven precursor fabric that is presently preferred is one in which:

i. 100% of the MD yarns are single monofilaments;
ii. 50% of the CD yarns are cabled monofilaments arranged so as to alternate in a regular A,B,A,B,A,B manner with single monofilaments; and
iii. the outside diameter of the cabled yarns is within 150% of the outside diameter of the single monofilaments oriented in the same direction.

BRIEF DESCRIPTION OF THE DRAWINGS

The invention will now be further described with reference to the drawings in which.

DETAILED DESCRIPTION OF THE PREFERRED EMBODIMENTS

Figure 1:
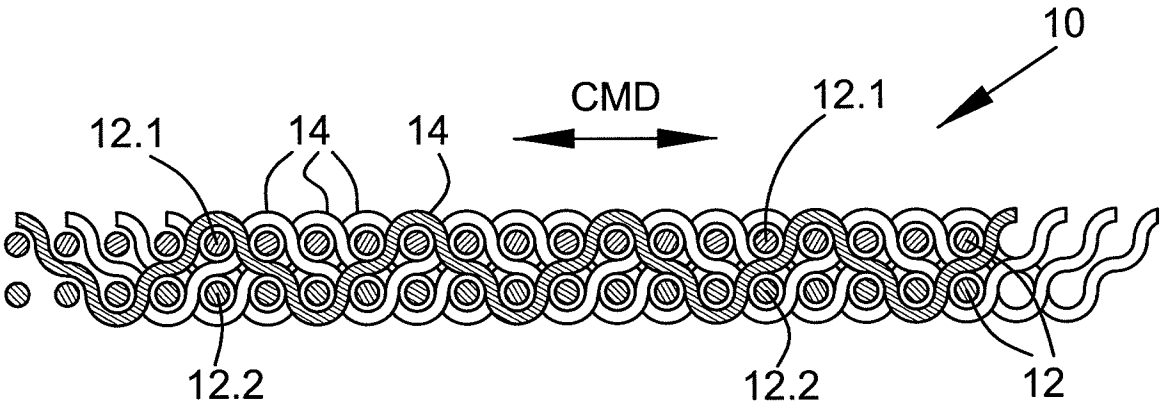
FIGURE 1 (PRIOR ART)
FIG. 1 is a schematic representation of a precursor textile strip used in the manufacture of a multiaxial press felt according the prior art teachings of U.S. Pat. No. 7,207,355 (Lee). In this fabric, all of the CD and MD yarns are monofilaments in accordance with the teachings of the patent.

As described herein, the term "warp" refers to component fabric yarns which are oriented in the intended machine direction, or MD, of the fabric, while the term "weft" refers to fabric yarns which are oriented perpendicular to the warp in the cross-machine direction, or CD, of the fabric and are interwoven with the warp yarns. As the vast majority of these precursor strips are flat woven, meaning the warp is paid out from a back beam at the loom as it is interwoven with the weft yarns, the terms "warp" and "weft" will generally be synonymous with the terms "MD" and "CD".

As used herein, the term "cabled yarn" refers to yarns comprised of at least two monofilaments which are joined together by twisting according to known means. For example, in a 2×2 construction, one pair of yarns that has been wrapped together are again twisted with one other similar pair of twisted monofilaments to provide a cabled yarn comprised of at least 4 monofilaments; a 2×3 construction would be comprised of 3 pairs of twisted yarns which are in turn twisted together. A 1×3 cable consists of three monofilaments cabled together in a manner similar to a twisted pair. One set of the yarns is usually cabled in a first direction (e.g. in the "S" direction) while the second is wrapped opposite to that (in the "Z" direction). Direction of twist is commonly expressed as "S"-twist or "Z"-twist and is dependent upon the direction of rotation of the twisting element.

Unless otherwise stated, the cabled yarns used in the fabrics of this invention consist of both "S" and "Z" cables and are preferably comprised of two or three pairs of mutually twisted and cabled monofilaments arranged in either a 2×2 or a 2×3 construction (i.e. a pair, twisted with a second pair, or three pairs cabled together), but it is also possible to use a 1×3 construction. Such yarns are well known and have been widely used in the press felt industry. However, prior to the present invention, their use in the manner described herein for fabric constructions similar to those disclosed by the '355 patent has not been proposed.

"Twist" is defined as the spiral disposition of the components of a cabled yarn, and is generally expressed as the number of turns per unit length of yarn, e.g. turns per inch, turns per meter, etc. Twist is essential to keep the component fibers together in a yarn; yarn strength is dependent on twist. As twist increases, the yarn strength increases first, reaches a maximum and then decreases. Depending on the end use, two or more single yarns are twisted together to form "plied yarns" and a number of plied yarns twisted together to form "cabled yarn". The term cabled yarn will be used throughout to refer to yarns including two or more components which are twisted together.

As used herein, the expression "at least one of X or Y" means X, Y, or a combination of X and Y, where X and Y represent elements of the invention. Additionally, the terms "a" and "one" mean one or more of the referenced item unless specifically noted otherwise.

FIG. 1 is diagrammatic representation of a portion of a woven precursor textile strip 10 made in accordance with the teachings of the '355 patent and having a width that is much less than an overall width of the desired papermaking fabric. The strip 10 is shown along a CD cross-section to illustrate its weave construction. The strip 10 includes a plurality of generally linearly extending, vertically stacked pairs of MD warp yarns 12 interwoven with CD weft yarns 14 according to a repeating pattern which maintains the vertically stacked alignment of the paired MD warp yarns such as 12.1 and 12.2. The warp yarns 12 include upper warp yarns 12.1 and lower warp yarns 12.2 that are in vertically stacked alignment over one another. All of the MD and CD yarns 12 and 14 are comprised of polymeric single monofilaments.

Figure 2:
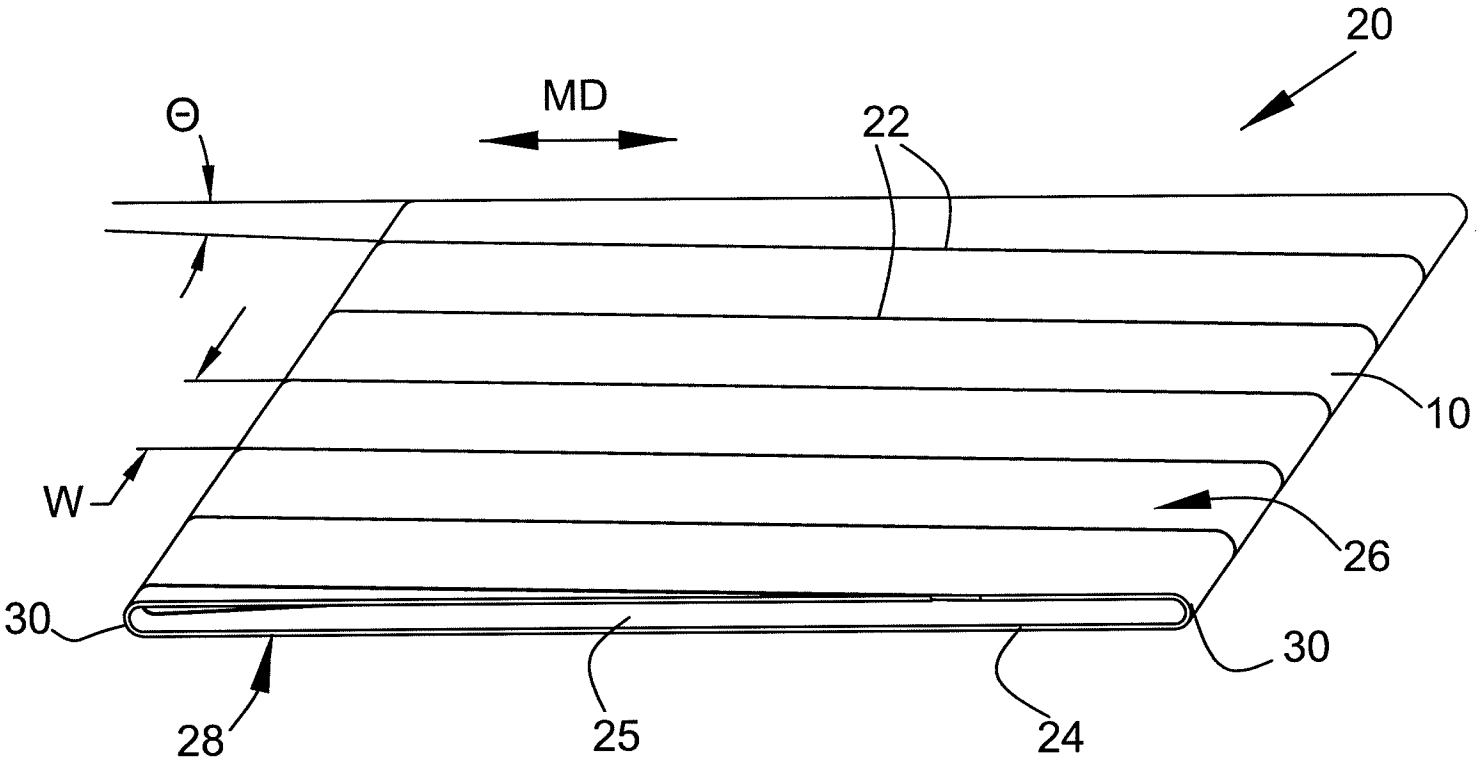
FIG. 2 is an illustration showing how the base fabric of the present invention is formed from the precursor textile strip.

FIG. 2 is a representation showing how the multiaxial press felt base fabric of the present invention is formed. As shown in FIG. 2, the precursor textile strip 10 has a width W which is less than an overall width of the desired papermaking fabric to be produced. Strip 10 is spirally wound as shown in FIG. 2 and joined together with each successive turn along neighboring adjacent edges 22 to form a fabric tube 24. The precursor textile strip 10 is spirally wound so that its component MD yarns 12.1, 12.2 are oriented at an angle Θ which is about 4° to a true machine direction of the final fabric. This angle can vary slightly depending upon a width of the precursor textile strip 10 and the overall length of the base fabric 20.

Following spiral assembly, the lateral outer edges of the fabric 20 are trimmed parallel to a true machine direction of the papermaking machine in which the fabric will be used. The adjacent edges 22 of the textile strip 10 are joined together in any known manner, such as by sewing, adhesives, melting, welding, gluing, and/or any other suitable method in order to form base fabric 20. As shown in FIG. 2, base fabric 20 is flattened to form a fabric tube 24 having upper layer 26 and lower layer 28 that are adjacent to one another at their mutual interior 25. The opposing ends of the base fabric 20 are formed by CD folds 30 in the fabric tube 24. Base fabric 20 is now a two-layer planar textile structure consisting of 4 layers of MD warp yarns and is ready for needling to attach one or more layers of a nonwoven batt material (not shown) to its surfaces. Following needling, a seam area will be created at the CD folds 30 which will allow the fabric to be rendered endless on the machine for which it is intended.

Figure 8:
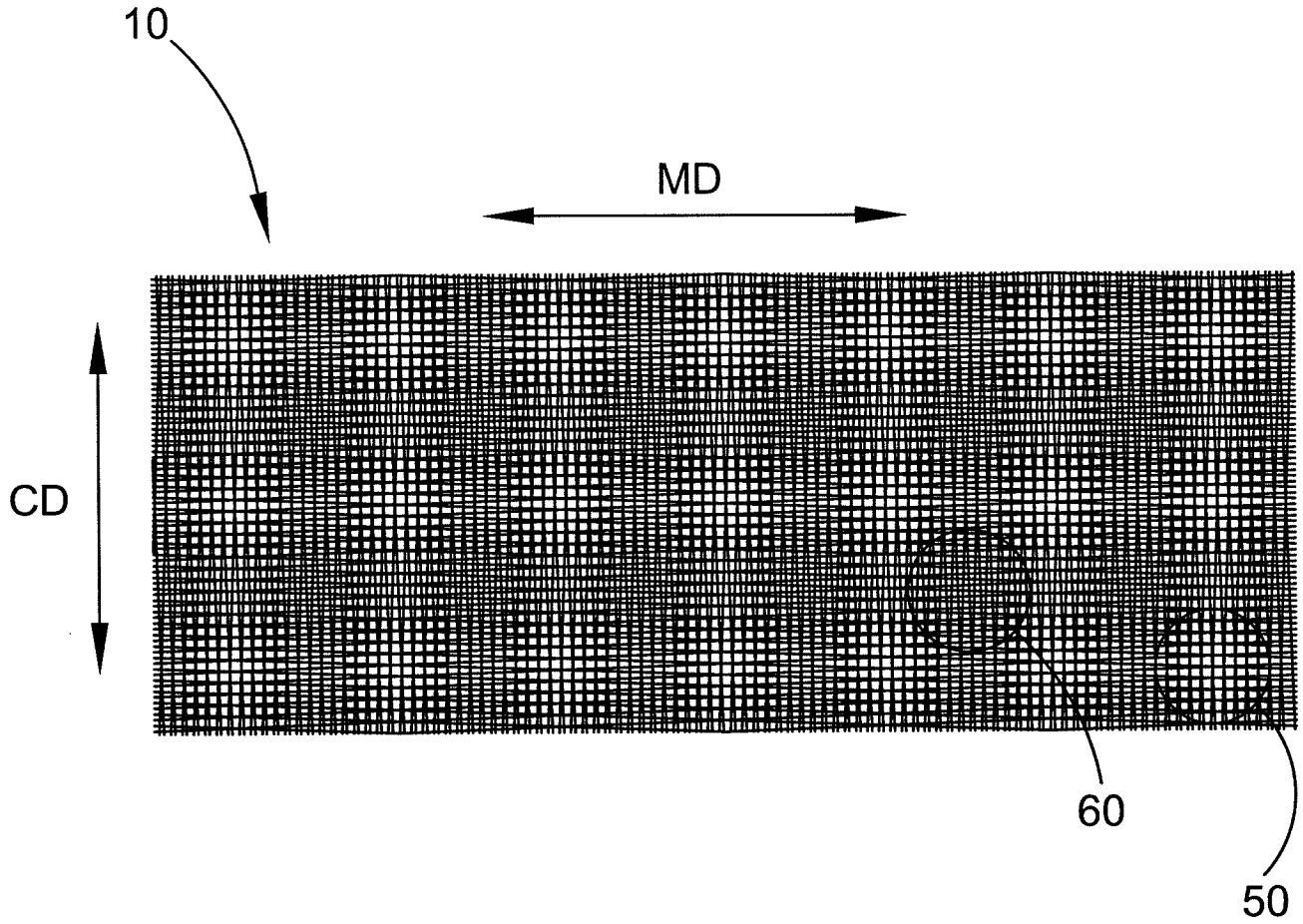
FIG. 8 is a diagram illustrating the interference patterns, or Moire effect, formed by two layers of woven monofilament fabric one laid over the other.
Figure 9:
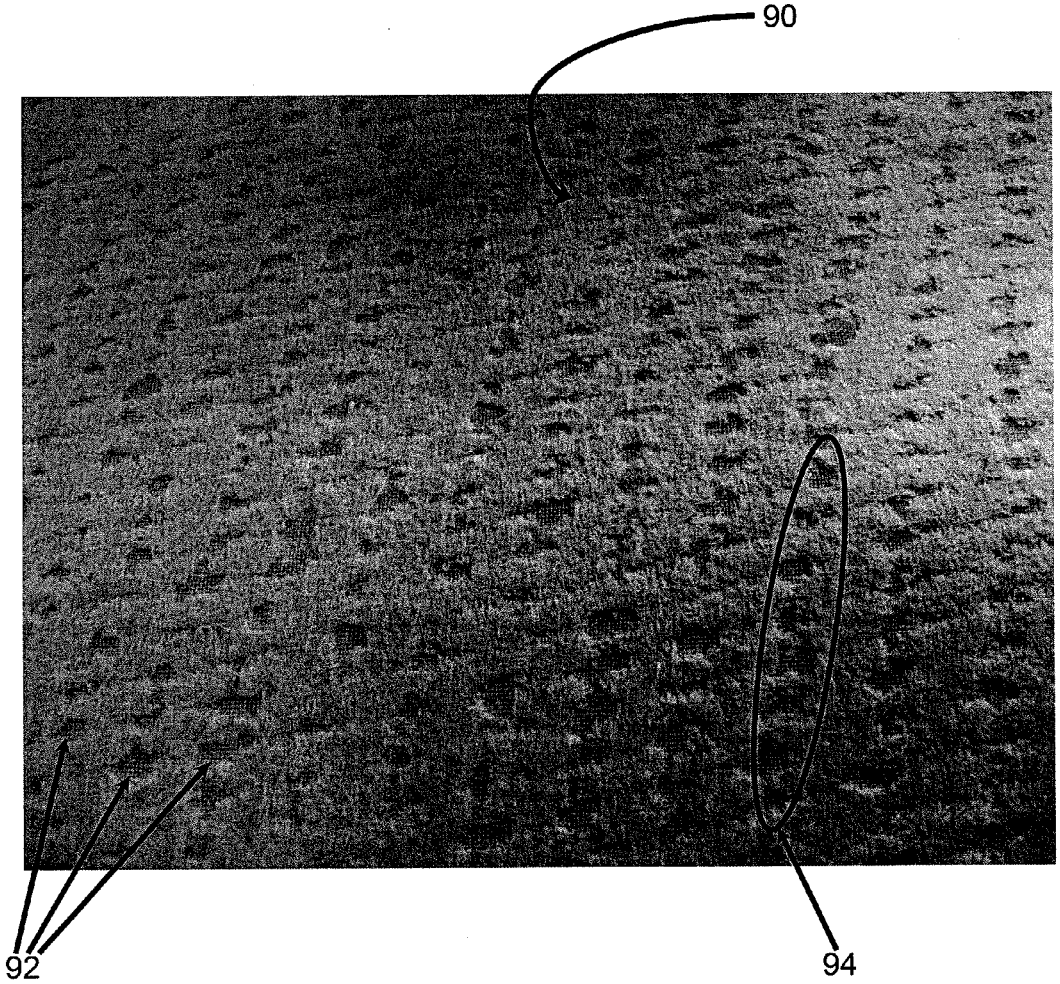
FIGURE 9 (PRIOR ART)
FIG. 9 is a photograph of a press felt according to the prior art exhibiting pronounced mass non-uniformity following use.

Prior to the present invention, collapsing the woven precursor fabric tube upon itself would frequently result in the formation of a Moiré type interference effect where the fabric layers overlay one another. This effect is illustrated in FIG. 8 and has been previously discussed. As shown in FIG. 8, one layer of woven textile such as 26 has been laid over a second layer of the same material such as 28 that is oriented at an equal but opposite angle to the MD as the first. Because the yarn density and yarn sizes are the same in both layers, the resulting two layer fabric exhibits a yarn interference pattern which produces areas of relative low yarn density, such as at 50, and areas of higher yarn density, such as at 60 in the fabric. When this fabric is used as a base fabric for a press felt, the regions 60 will provide better anchorage for batt fibers which are needled into this area of the base fabric than will areas of lower yarn density such as 50. During use, the fabric will tend to shed batt fiber more quickly at regions 50 than at regions 60, resulting in a non-uniform distribution of batt material over time. This is shown in FIG. 9, which is a photograph of a used, prior art multiaxial press felt exhibiting non-uniform batt distribution due to the interference pattern created in the base fabric due to the overlay of the two layers as discussed above. The felt presented in FIG. 9 shows that this shedding effect can be extreme and can render a fabric completely unsuitable for use. As can be seen, the PS surface 90 of the fabric of FIG. 9 is pock-marked with depressions such as 92 where batt has come completely away from the base fabric; these depressions form a regular pattern such as at 94 corresponding to repeating areas of low yarn density such as 50 shown in FIG. 8.

Figure 3A:
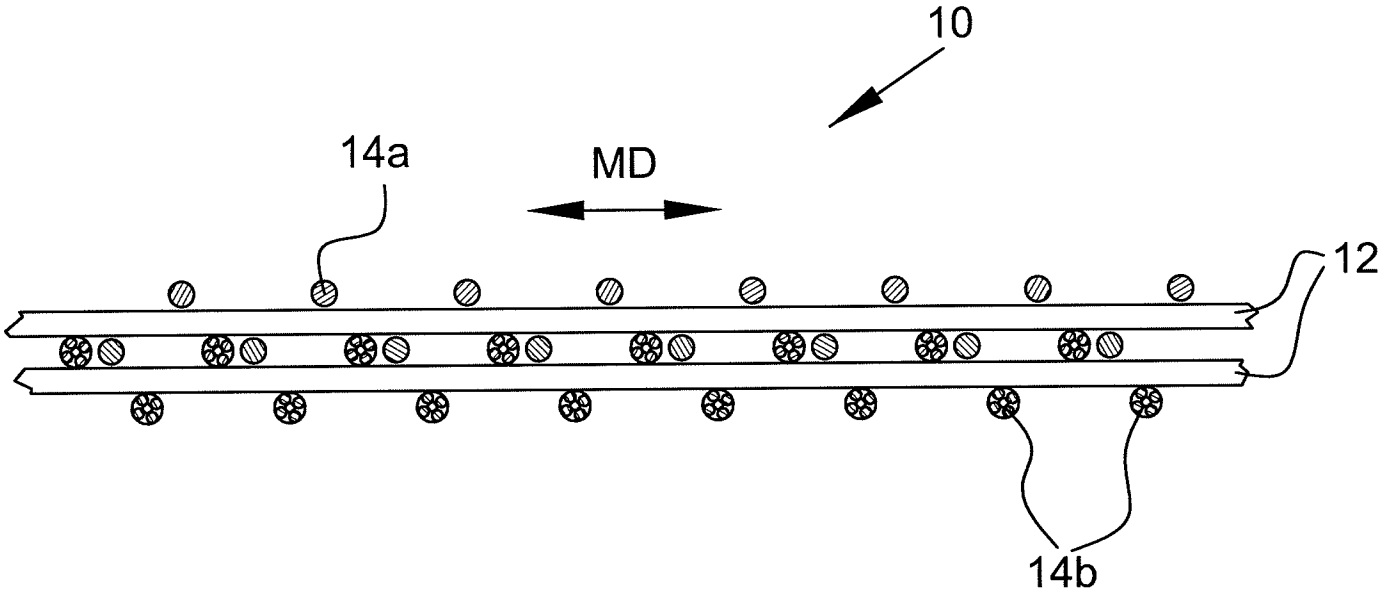
FIGS. 3A and 3B are schematic representations of a precursor textile strip used in multiaxial press felt base fabrics constructed according to the teachings of the present invention in which 50% of the CD yarns are cabled yarns.
Figure 3B:
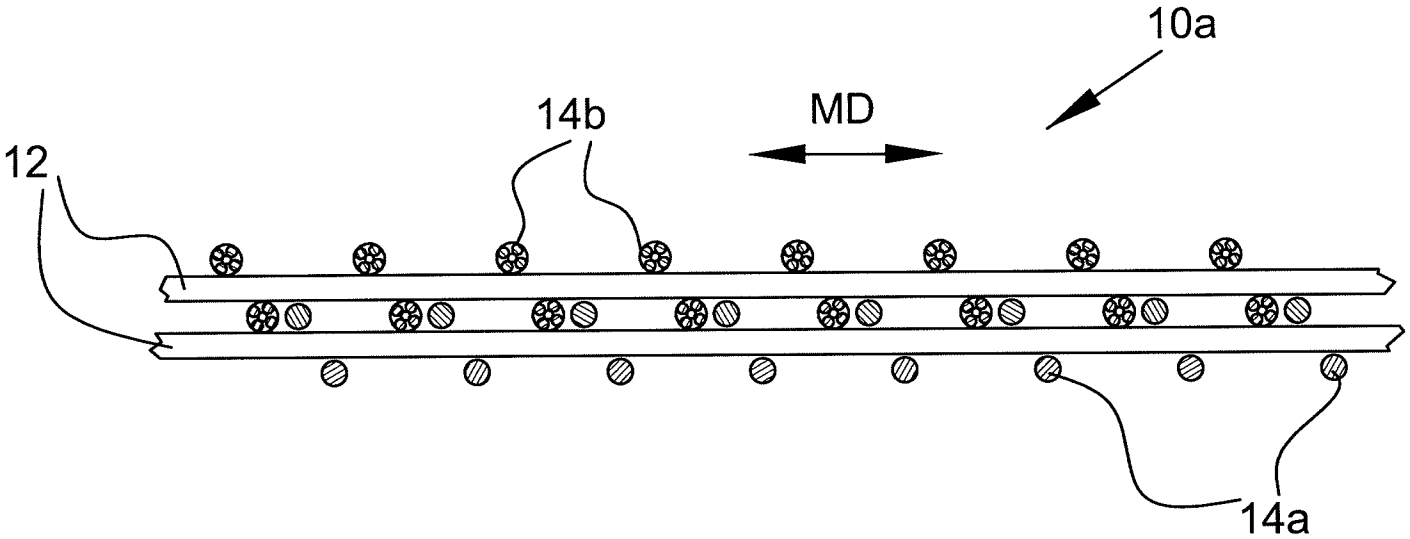

FIGS. 3A and 3B are diagrammatic representations of a first and second embodiment of precursor textile strips 10 and 10*a* constructed according to the present invention. As shown in these Figures, the individual yarns of two layers of warp yarns designated generally as 12 are in vertically stacked alignment and are interwoven with a system of weft yarns of which yarns 14*a* and 14*b* are representative. The warp yarns 12 are single solid monofilaments, the weft yarns 14*a* are also single monofilaments, while the weft yarns 14*b* are cabled yarns comprising in this embodiment two monofilaments cabled together and then twisted with a second pair of monofilaments similarly cabled together to provide a 2×2 cable. A similar suitable arrangement could be made using a 3×2 or 1×3 cable. As can be seen in FIG. 3A, the cabled weft yarns 14*b* in strip 10 alternate regularly with the single monofilament weft yarns 14*a* in an A,B,A,B,A,B, etc. manner such that 50% of the weft yarns in the strip are comprised of cabled yarns, while the remaining 50% are solid monofilaments. A similar arrangement is shown in FIG. 3B except that in fabric 10*a* the alternation of the cabled yarns with single monofilaments is in an AA,BB,AA,BB etc. pattern resulting, in both cases, that 50% of the weft yarns in both of the strips are cabled yarns. Also in both cases, the outside diameter of the cabled weft yarns 14*b* is within about 150% of the outside diameter of the single monofilament weft yarns 14*a*.

Figure 4:
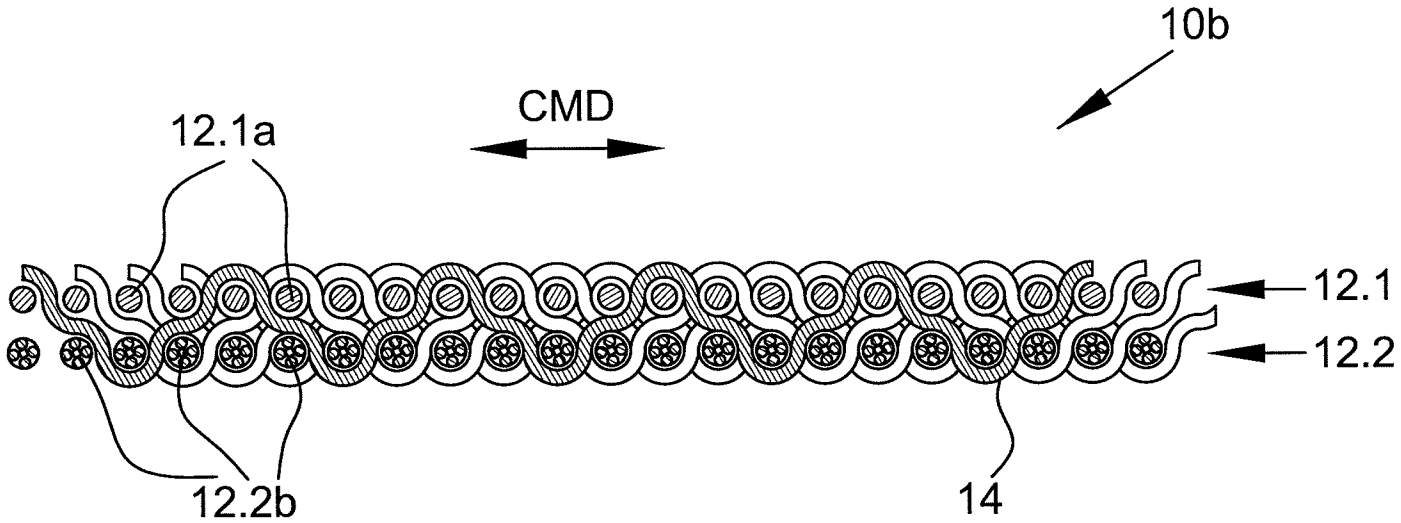
FIG. 4 is a schematic representation of a precursor textile strip used in multiaxial press felt base fabrics constructed according to the teachings of the present invention in which 50% of the MD yarns are cabled yarns.

FIG. 4 is a diagrammatic representation of a precursor textile strip 10*b* prepared according to the teachings of the present invention and in which 50% of the MD warp yarns are cabled yarns while the remaining 50% of the warp yarns are single monofilaments. As can be seen from FIG. 4, strip 10*b* is comprised of two layers of MD warp yarns, designated 12.1 and 12.2, which are interwoven with CD weft yarns 14 according to a weave pattern which maintains the warp yarns 12.1 and 12.2 as vertically stacked pairs. In this embodiment, 100% of the warp yarns in one layer of the strip 10 are cabled yarns, as shown at 12.2*b*, thus comprising 50% of the MD yarns in the fabric, while the remaining 50% of the warp yarns, as shown at 12.1*a*, are single polymeric monofilaments. In a preferred embodiment of the invention, the cabled yarns 12.2*b* are oriented in the precursor strip 10*b* so they face the interior 25 of the base fabric 20 when the fabric tube 24 is flattened (see FIG. 5). When this is done, the single monofilament warp yarns 12.1*a* will then be used to form seaming loops at the CD folds 30. However, this is not always necessary, and it is within the scope of the invention to orient the cabled MD warp yarns 12.2*b* to the exterior of the tube and thus use them to form the seaming loops (not shown) for the finished textile.

Figure 5:
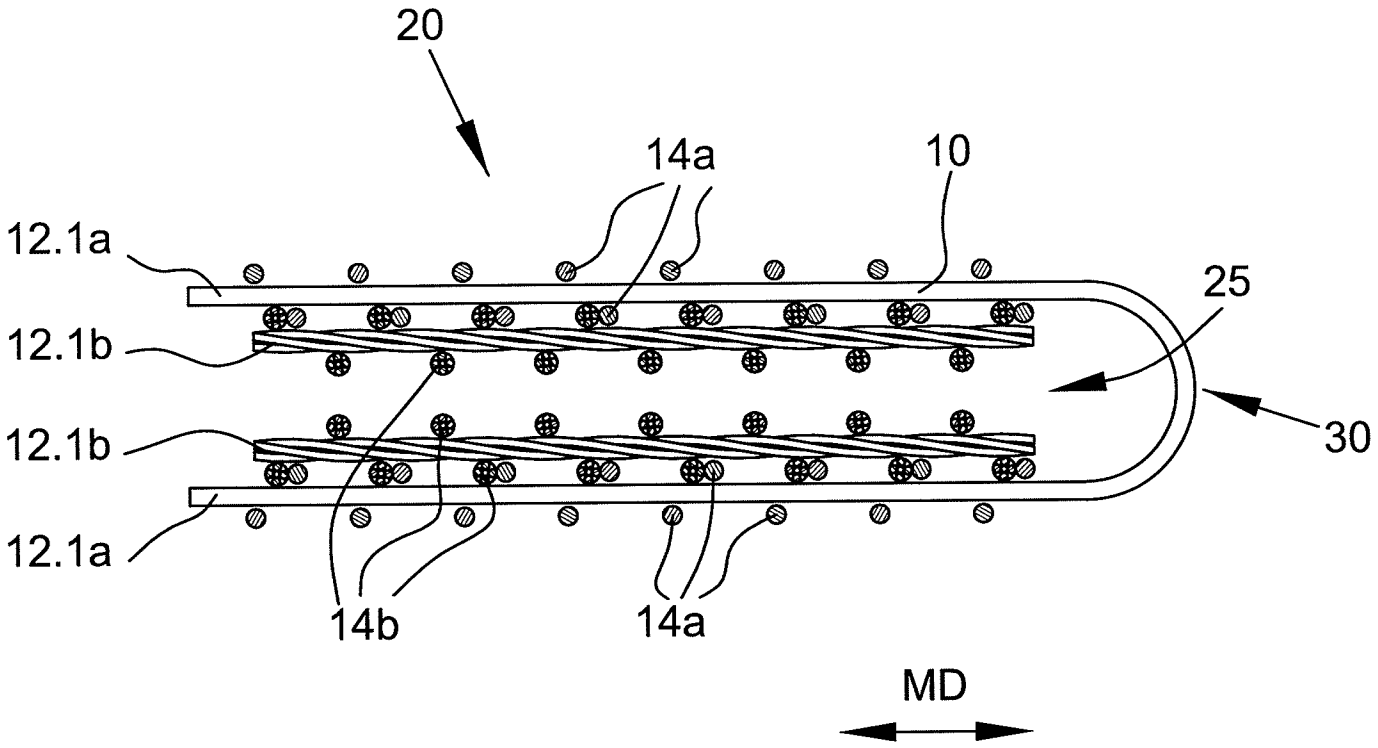
FIG. 5 is a schematic representation of a precursor textile strip for use in multiaxial press felt base fabrics constructed according to the teachings of the present invention in which 50% of the CD yarns and 50% of the MD yarns are cabled yarns.

FIG. 5 is a schematic representation of a precursor textile strip constructed in accordance with the teachings of the present invention and in which 50% of the CD yarns and 50% of the MD yarns are cabled yarns, with the remainder being single monofilament yarns. As shown in FIG. 5, the precursor textile strip 10 is comprised of two vertically stacked layers of MD warp yarns 12.1*a* and 12.2*b* which are interwoven with CD weft yarns such as 14*a* and 14*b*. As shown in FIG. 5, MD yarns 12.1*a* are single monofilaments and are arranged so as to be located towards the outer or exterior layer of the base fabric precursor 20. MD yarns 12.2*b* are cabled monofilaments having one of a 1×3, 2×2 or 2×3 construction as discussed above. CD weft yarns 14*a* are single monofilaments, while CD weft yarns 14*b* are cabled monofilaments also having one of a 1×3, 2×2 or 2×3 construction. As shown in FIG. 5, fabric precursor 20 is illustrated as if part of a multiaxial press felt base fabric (not shown) and includes a seam area at fold region 30 where single monofilament warp yarns 12.1*a* form a loop. The interior of the fabric 25 is created in the manner described in relation to FIG. 2 by collapsing the spirally wound tube to form a two layer flat fabric. It will be noted that cabled MD warp yarns 12.2*b* are oriented to the interior 25 of the fabric in this construction, and the seam loops are formed from single monofilaments 12.1*a* and located at fold area 30. It is also possible to form the seam loops at fold 30 using the cabled yarns 12.2*b*. As a further alternative, additional cabled CD weft yarns such as 14*b* may be inserted at the fold area 30 so as to "stuff" this region of the fabric to improve batt adhesion adjacent the eventual seam area.

Figure 7:
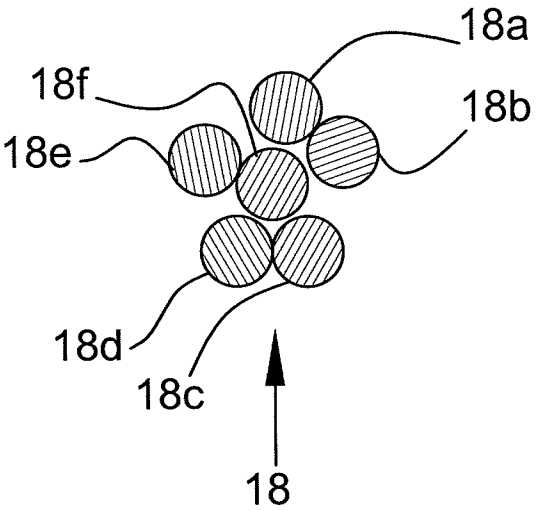
FIG. 7 is a schematic representation of a 0.15 mm×2×3 cabled yarn as seen in cross-section.

In the fabrics of the present invention, it is anticipated that cabled monofilament yarns will provide satisfactory results with respect to batt adhesion and other properties relevant to the final fabric. However, it is within the scope of the invention to use cabled yarns which include additional components or features, examples of which are shown in FIGS. 6 and 7.

Figure 6:
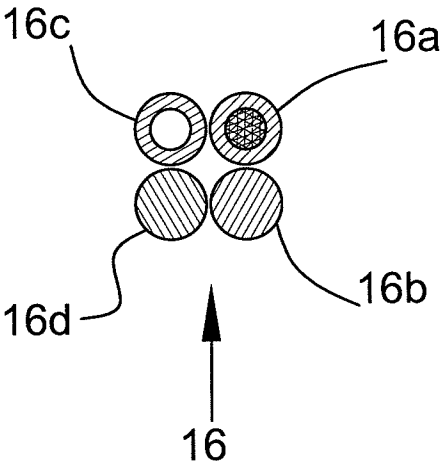
FIG. 6 is a schematic representation of a 0.2 mm×2×2 cabled yarn as seen in cross-section.

FIG. 6 is a schematic representation of a 0.2 mm×2×2 cabled yarn 16 as seen in cross-section. As shown, the four yarns 16*a*, 16*b*, 16*c* and 16*d* are each round 0.2 mm diameter monofilaments. Yarn 16*a* is shown to be a bi-component yarn including a low melt adhesive material as one component arranged so as to surround a core comprised of a polymer having a comparatively higher melt point. When incorporated such as by weaving into a fabric of the present invention, the low melt component of cabled yarn 16*a* may be melted by heat treatment and will assist in providing anchorage for the batt and overall fabric smoothness. Yarn 16*c* is shown as a hollow monofilament which may contribute to fabric smoothness due to its compressibility. Yarns 16*b* and 16*d* are both solid polymeric monofilaments and may be comprised of the same or a different polymer as appropriate. In the cabled yarn construction 16, two of the yarns, for example 16*a* and 16*b*, are first twisted about one another; yarns 16*c* and 16*d* are similarly twisted, and the two pairs 16*a* & 16*b*, and 16*c* & 16*d* are then cabled together to form a single cabled yarn 16. Yarn 16 is exemplary of one type of yarn used in the precursor textile strips comprising the multiaxial press felts of the present invention. Other sizes of monofilaments could also be used. The outside diameter of this yarn is approximately 0.4 mm when each of the individual components such as 16*b* is about 02.mm in diameter. This size can also be varied, but should within about 150% of the diameter of the monofilaments FIG. 7 is a schematic representation of a 0.15×2×3 cabled yarn 18 as seen in cross-section. The six yarns 18*a*, 18*b*, 18*c*, 18*d*, 18*e* and 18*f* are each round monofilaments and have a diameter, in this embodiment, of 0.15 mm. As shown, two of the yarns, for example 18*a* and 18*b*, are first twisted about one another; yarns 18*c* &18*d*, and 18*e* & 18*f* are similarly twisted, and the three pairs 18*a* & 18*b*, 18*c* & 18*d*, and 18*e* & 18*f* are then cabled together in a known manner to form a single strand. As in FIG. 6, one or more of the yarns 18*a*-18*f* may have a bi-component structure including a low-melt adhesive or they may be hollow or have a differing structure from the other yarns in the cable. Yarn 18 is exemplary of a second type of yarn which may be used in the precursor textile strips comprising the multiaxial press felts of the present invention and would have an outside diameter of about 0.45 mm when each of the yarn components is about 0.15 mm in diameter.

Table 1 below illustrates several preferred combinations of cabled and monofilament yarns in the press felts of the present invention.

TABLE 1

Preferred Base Fabric Constructions

| Base Fabric Construction No. | MD Yarn 1 (mm) | MD Yarn 2 (mm) | CD Yarn 1 (mm) | CD Yarn 2 (mm) |
|---|---|---|---|---|
| 1 | 0.4 | 0.4 | 0.3 | 0.2 × 2 × 2 |
| 2 | 0.4 | 0.4 | 0.3 | 0.15 × 2 × 3 |
| 3 | 0.4 | 0.2 × 2 × 2 | 0.3 | 0.3 |
| 4 | 0.4 | 0.2 × 2 × 2 | 0.3 | 0.2 × 2 × 2 |
| 5 | 0.4 | 0.2 × 2 × 2 | 0.3 | 0.15 × 2 × 3 |

In Table 1, Construction 1 represents a precursor textile strip in which 100% of the MD yarns are 0.4 mm diameter single monofilaments. These warp yarns are interwoven with CD weft yarns of which 50% are 0.3 mm diameter single monofilaments (CD yarn 1) and the remaining 50% are cabled yarns (CD Yarn 2). The cabled yarns are thus comprised of four 0.2 mm monofilaments organized in a 0.2×2×2 cabling arrangement. The outside diameter of the cabled CD yarn 2 is 0.4 mm which is within about 150% of the diameter of the outside diameter of CD Yarn 1 at 0.3 mm. Cabled CD Yarn 2 alternates with CD Yarn 1 in an A,B,A,B,A,B repeating arrangement in the precursor textile strip. Construction 1 corresponds to that shown in FIG. 3A.

Construction 2 is similar to Construction 1 except that the 0.2 mm diameter cabled monofilaments of CD Yarn 2 have been replaced with 0.15 mm diameter monofilaments, three pairs of which are cabled together (0.15×2×3). The outside diameter of CD Yarn 2 is approximately 0.45 mm is within about 150% of the 0.3 mm diameter of CD Yarn 1.

In Construction 3, all of the CD yarns are 0.3 mm diameter single monofilaments. However, MD Yarn 2 which is oriented towards the interior of the fabric, is now a cabled yarn of 0.2×2×2 composition. In this case 50% of the MD yarns of the fabric strip are now cabled yarns and these occupy 100% of the MD yarns located towards the interior of the fabric tube, while the remaining yarns, accounting for 100% of the yarns in the PS of the fabric, are monofilaments whose diameter is 0.4 mm. The outside diameter of MD Yarn 2 is approximately 0.4 mm and is within about 150% of the diameter of MD Yarn 1. Construction 3 corresponds to that shown in FIG. 4.

Construction 4 is the same as Construction 3, except 50% of the CD yarns are cabled yarns (CD Yarn 2) while the remaining 50% are monofilaments (CD Yarn 1). The diameter of CD Yarn 1 is 0.3 mm, while the diameter of the cabled yarns of CD Yarn 2 is approximately 0.4 mm. The diameter of MD Yarn 1 is 0.4 mm while the diameter of MD Yarn 2 is approximately 0.4 mm. In both cases, the outside diameter of the cabled yarns used in Construction 4 is within about 150% of the diameter of the monofilament yarns oriented in the same direction. Construction 4 corresponds to that shown in FIG. 5.

Construction 5 is essentially the same as Construction 4, except that the 0.2 mm×2×2 cabled CD Yarn 2 is replaced with a 0.15 mm×2×3 cabled CD Yarn 2 whose outside diameter is approximately 0.45 mm.

The cabling constructions presented in Table 2 have been found to be suitable; others may be effective.

In Table 2, "Cable Component Size" refers to the diameter of the monofilaments used in the cable; "Cable Type" refers to the number of yarns in the cable and its construction; "Twists per Inch" refers to the number of twists per unit length imparted to the cables or yarns, while the notations "S" and "Z" refer to the orientation of the twists. For example, in Cable Type 2×3, two of the cabled yarns are twisted together 5.8 times per inch in the Z direction, while those of the other pair are twisted 4.9 times per inch in the "S" orientation.

TABLE 2

Yarn Construction and Cabling

| Cable Component Size (mm) | Cable Type | Twists per Inch |
|---|---|---|
| 0.15 | 2 × 3 | 5.8 Z/4.9 S |
| 0.20 | 2 × 2 | 8.5 Z/5.7 S |
| 0.20 | 2 × 2 | 10.0 Z/6.0 S |
| 0.25 | 1 × 3 | 12.9 Z/9.2 S |

Cabled yarns such as those described in Table 2 are readily available from various suppliers or contractors, and cable constructions suitable for use in the present invention can be provided using yarns of the desired sizes and compositions.

Experimental Fabrics

Experimental base fabrics were produced using the yarn types and sizes shown as Constructions 1, 2 and 3 provided in Table 1. The precursor textile strips were woven according to the arrangement described in the '355 patent and were assembled according to the spiral winding process. Several layers of a nonwoven fibrous batt material were needled to the PS and MS surfaces of the assembled base fabrics. A control fabric was also produced according to the '355 patent but did not contain cabled yarns in accordance with the teachings of the present invention. Both the experimental and control fabrics were introduced to a test apparatus which simulates paper machine press conditions. The fabrics were run wet at machine speeds around numerous rolls, over a vacuum dewatering box and through at least one press nip which provided repetitive compressive forces similar to that to which the felts would be exposed on a paper machine. The fabrics were tested for mass uniformity and sheet smoothness following the test runs. It was found that the experimental fabric constructions made in accordance with the teachings of the invention exhibited improved mass uniformity and sheet smoothness properties in comparison to the control fabric.

Further tests were conducted to compare the batt anchorage strength of a prior art press felt produced according to the teaching of the '355 patent to the batt anchorage strength in fabrics made according to the present invention. To do this, several press felts were produced according to the '355 patent as controls while several were also prepared according to the teaching of the present invention. Both the control and experimental fabrics were needled using the same batt and needle density according to the same construction. Samples of each of the control and experimental felts were then split in half in the MD over a short distance through their thickness between the two base layers. The two split ends were then attached to jaws on an Instron type CRE tensile testing machine and the force required to further peel the two layers apart over a distance of three inches (7.62 cm) was measured. It was found that when as few as 50% of the CD monofilament weft yarns were replaced with cabled yarns, constructed according to either a 0.15 mm×2×3 or 0.2 mm×2×2 cabling configuration, the force required to pull the two layers apart increased by from 50% to 100% in comparison to the control samples which did not include cabled yarns. This indicates that batt anchorage in fabrics constructed according to the present invention is significantly improved in comparison to the same property in fabrics made according to the prior art.

Fabrics made according to the '355 patent resist compression due to the unique stacking arrangement of the warp yarns. In order to determine whether fabrics according to the present invention would perform in a similar manner with respect to compression, samples were tested using a laboratory test apparatus to measure changes in caliper under dynamic compression. The experimental and control samples were the same as used in the previous test. The samples were each run through 12,000 cycles on a press apparatus and their caliper and void volume measured at regular intervals. It was found that there was virtually no difference between the control and experimental fabrics with respect to either of these properties, which are important with regard to dewatering and overall press felt performance.

In summary, a multiaxial press felt base fabric construction is provided in which the base fabric is formed from a spirally wound precursor textile strip having a width that is less than an overall width of the assembled papermaking fabric and which is joined together along neighboring adjacent edges to form a fabric tube, and at least one of: 100% of the MD yarns located on one surface of the precursor textile strip are comprised of cabled yarns or from 50% to 100% of the CD yarns are a cabled yarn; the MD yarns are arranged as vertically stacked pairs for compression resistance and to provide void volume, and the vertically stacked arrangement is maintained by interweaving with one system of CD weft yarns. This provides for a reduction in Moiré effect resulting from the spirally wound precursor textile strip arrangement, as well as for greater uniformity in batt retention during use.

The invention claimed is:

1. A multi-axial papermaking fabric having a paper side (PS) surface and a machine side (MS) surface, the fabric comprising:

a base fabric formed from a woven and spirally wound precursor textile strip having a width that is less than an overall width of the assembled press felt and which is joined together along neighboring longitudinal edges to form a fabric tube;

the precursor textile strip comprising a plurality of generally linearly extending vertically stacked pairs of machine direction (MD) warp yarns interwoven with a system of cross-machine direction (CD) weft yarns in a repeat pattern which maintains a vertically stacked alignment of the pairs of MD warp yarns such that 50% of the pairs of MD warp yarns are located on a first surface of the strip, and a remaining 50% of the pairs of MD warp yarns are located on a second surface of the precursor textile strip;

the precursor textile strip further including both polymeric single monofilament and cabled yarns;

wherein the cabled yarns comprise at least two monofilaments cabled together and the cabled yarns comprise at least 50% of at least one of the CD or MD yarn systems, the cabled yarns are comprised of cabled polymeric yarns selected from: monofilaments, bi-component yarns or hollow yarns, and the cabled yarns consist of two pairs of twisted polymeric yarns which are twisted together.

2. A fabric according to claim 1 wherein the fabric tube comprises an upper layer and a lower layer formed from successive turns of the spirally wound precursor textile strip, the upper and lower layers being positioned vertically adjacent to one another in the base fabric, ends of the base fabric are formed by CD folds in the fabric tube to provide seaming areas, the MD warp yarns of each of the first and second surfaces of the strip being in a generally vertically stacked alignment within both of the layers adjacent to the folded ends of the base fabric to provide at least some continuously extending ones of the MD warp yarns from the first and second surface of the strip between the upper and lower layers at the seaming areas, and seaming loops are formed from at least some of the continuously extending ones of the MD monofilament yarns located at the CD folds in the fabric tube.

3. A fabric according to claim 1 wherein the cabled yarns comprise 100% of the MD yarns in the first surface of the precursor textile strip.

4. A fabric according to claim 1 wherein the cabled yarns comprise 100% of the MD yarns in the second surface of the precursor textile strip.

5. A fabric according to claim 1 wherein the cabled yarns comprise from 50% to 100% of the CD yarns of the precursor textile strip.

6. A fabric according to claim 1 wherein the cabled yarns comprise from 50% of the CD yarns of the precursor textile strip and 100% of the MD yarns in one of the first surface or the second surface of the precursor textile strip.

7. A fabric according to claim 1 wherein the cabled yarn includes a multifilament sheath.

8. A fabric according to claim 1 wherein the cabled yarns are comprised of the bi-component yarns, and the bi-component yarn includes a low melt polymer adhesive as one of its components.

9. A fabric according to claim 1 wherein the cabled yarns consist of monofilaments whose diameter ranges from 0.10 to 0.3 mm.

10. A fabric according to claim 9 wherein the cabled yarns comprise 100% of the MD yarns of one of the two MD layers.

11. A fabric according to claim 1 wherein a cross-sectional shape of the single monofilament yarns is selected from: round, ovate, elliptical, rectangular, or flat.

12. A fabric according to claim 11 wherein the cross-sectional shape of the single monofilament is hollow.

13. A fabric according to claim 11 wherein a diameter of the single monofilament yarns is from about 0.3 to about 0.4 mm.

14. A fabric according to claim 1 wherein at least some of the monofilaments in the cabled yarns are bi-component yarns.

15. A fabric according to claim 14 wherein a diameter of the single monofilament yarns is from about 0.3 to about 0.4 mm.

16. A fabric according to claim 1 wherein the polymer from which the polymeric single monofilament and the cabled yarns are formed is selected from: a nylon, a polyester, a polyurethane, a polymer blend or a copolymer.

17. A multi-axial papermaking fabric having a paper side (PS) surface and a machine side (MS) surface, the fabric comprising:

a base fabric formed from a woven and spirally wound precursor textile strip having a width that is less than an overall width of the assembled press felt and which is joined together along neighboring longitudinal edges to form a fabric tube;

the precursor textile strip comprising a plurality of generally linearly extending vertically stacked pairs of machine direction (MD) warp yarns interwoven with a system of cross-machine direction (CD) weft yarns in a repeat pattern which maintains a vertically stacked alignment of the pairs of MD warp yarns such that 50% of the pairs of MD warp yarns are located on a first surface of the strip, and a remaining 50% of the pairs of MD warp yarns are located on a second surface of the precursor textile strip;

the precursor textile strip further including both polymeric single monofilament and cabled yarns;

wherein the cabled yarns comprise at least two monofilaments cabled together and the cabled yarns comprise at least 50% of at least one of the CD or MD yarn systems, the cabled yarns are comprised of cabled polymeric yarns selected from: monofilaments, bi-component yarns or hollow yarns, and the cabled yarns consist of three pairs of twisted monofilaments which are twisted together.

18. A multi-axial papermaking fabric having a paper side (PS) surface and a machine side (MS) surface, the fabric comprising:

a base fabric formed from a woven and spirally wound precursor textile strip having a width that is less than an overall width of the assembled press felt and which is joined together along neighboring longitudinal edges to form a fabric tube;

the precursor textile strip comprising a plurality of generally linearly extending vertically stacked pairs of machine direction (MD) warp yarns interwoven with a system of cross-machine direction (CD) weft yarns in a repeat pattern which maintains a vertically stacked alignment of the pairs of MD warp yarns such that 50% of the pairs of MD warp yarns are located on a first surface of the strip, and a remaining 50% of the pairs of MD warp yarns are located on a second surface of the precursor textile strip;

the precursor textile strip further including both polymeric single monofilament and cabled yarns;

wherein the cabled yarns comprise at least two monofilaments cabled together and the cabled yarns comprise 50% of the CD yarns, and the cabled yarns in the CD alternate with the single monofilament yarns in the CD of the fabric according to a repeating pattern in the MD of the fabric such that 50% of the CD yarns are the single monofilaments and a remaining 50% of the CD yarns are the cabled yarns.

19. A multi-axial papermaking fabric having a paper side (PS) surface and a machine side (MS) surface, the fabric comprising:

a base fabric formed from a woven and spirally wound precursor textile strip having a width that is less than an overall width of the assembled press felt and which is joined together along neighboring longitudinal edges to form a fabric tube;

the precursor textile strip comprising a plurality of generally linearly extending vertically stacked pairs of machine direction (MD) warp yarns interwoven with a system of cross-machine direction (CD) weft yarns in a repeat pattern which maintains a vertically stacked alignment of the pairs of MD warp yarns such that 50% of the pairs of MD warp yarns are located on a first surface of the strip, and a remaining 50% of the pairs of MD warp yarns are located on a second surface of the precursor textile strip;

the precursor textile strip further including both polymeric single monofilament and cabled yarns;

wherein the cabled yarns comprise at least two monofilaments cabled together and the cabled yarns comprise at least 50% of at least one of the CD or MD yarn systems; and an outside diameter of the cabled yarns is within about 150% of a diameter of the single monofilament yarns oriented in a same direction.

* * * * *